US011389683B2

(12) United States Patent
McCalester

(10) Patent No.: US 11,389,683 B2
(45) Date of Patent: Jul. 19, 2022

(54) GYMNASTICS SWING SHAPE TRAINER

(71) Applicant: Gregory C. McCalester, Santee, CA (US)

(72) Inventor: Gregory C. McCalester, Santee, CA (US)

( * ) Notice: Subject to any disclaimer, the term of this patent is extended or adjusted under 35 U.S.C. 154(b) by 90 days.

(21) Appl. No.: 16/696,009

(22) Filed: Nov. 26, 2019

(65) Prior Publication Data

US 2021/0154515 A1 May 27, 2021

(51) Int. Cl.
*A63B 1/00* (2006.01)
*A63B 21/16* (2006.01)

(52) U.S. Cl.
CPC ..... *A63B 1/00* (2013.01); *A63B 1/005* (2013.01); *A63B 21/169* (2015.10); *A63B 2225/093* (2013.01)

(58) Field of Classification Search
CPC .. A63B 1/00; A63B 1/005; A63B 1/04; A63B 3/00; A63B 5/00; A63B 5/02; A63B 5/06; A63B 7/00; A63B 7/02; A63B 7/04; A63B 7/045; A63B 7/08; A63B 7/085; A63B 9/00; A63B 2009/002; A63B 2009/004; A63B 2009/006; A63B 2009/008; A63B 15/00; A63B 15/005; A63B 15/02; A63B 17/00; A63B 17/02; A63B 17/04; A63B 21/00; A63B 21/00047; A63B 21/0005; A63B 21/00054; A63B 21/04; A63B 21/0407; A63B 21/0414; A63B 21/062; A63B 21/0624; A63B 21/0628; A63B 21/072; A63B 21/0722; A63B 21/0724; A63B 21/0728; A63B 21/075; A63B 21/078; A63B 22/00;

(Continued)

(56) References Cited

U.S. PATENT DOCUMENTS 510,562 A * 12/1893 Breslin ..... A47B 57/16 211/153
715,530 A * 12/1902 Wallace ..... A63B 1/00 211/206

(Continued)

FOREIGN PATENT DOCUMENTS

CN 205287451 U 6/2016
CN 205549394 U 9/2016
CN 209270717 U 8/2019

OTHER PUBLICATIONS https://www.amazon.com/Adjustable-Agility-Training-Exercise-Multi-Choices/dp/B07F5FQNB1.

*Primary Examiner* — Megan Anderson
*Assistant Examiner* — Thao N Do
(74) *Attorney, Agent, or Firm* — Olson & Cepuritis, Ltd.

(57) ABSTRACT

The present invention provides for a gymnastics swing trainer. The device comprises two parallel side support members and two fixed rungs forming a rectangular frame. An adjustable rung may be positioned along the side support members to accommodate the size of the user. A gymnast grasps the adjustable rung while placing her feet on the lower fixed rung. The rungs should be spaced the proper distance apart to allow the gymnast to maintain the proper hollow body position required for uneven parallel bar skills. Repeated training with the device allows for the proper body position to become an automatic response or to be retained in "muscle memory" such that the gymnast can focus on the skill while maintaining proper position.

5 Claims, 4 Drawing Sheets

(58) Field of Classification Search
CPC ..... A63B 22/0002; A63B 22/0005; A63B 22/007; A63B 22/001; A63B 22/0012; A63B 22/0015; A63B 22/0017; A63B 22/0046; A63B 2225/10; A47F 10/00; E06C 1/00; E06C 1/005; E06C 1/02; E06C 1/04; E06C 1/06; E06C 1/08; E06C 1/10; E06C 1/12; E06C 1/125; E06C 1/14; E06C 1/16; E06C 1/18; E06C 1/20; E06C 1/22; E06C 1/24; E06C 1/26; E06C 1/28; E06C 1/30; E06C 1/32; E06C 1/34; E06C 1/345; E06C 1/36; E06C 1/38; E06C 1/381; E06C 1/382; E06C 1/383; E06C 1/3835; E06C 1/387; E06C 1/39; E06C 1/393; E06C 1/397; E06C 1/52; E06C 1/525; E06C 1/54; E06C 1/56; E06C 1/58; A47B 57/06; A47B 57/08; A47B 57/10; A47B 57/12; A47B 57/14; A47B 57/16
See application file for complete search history.

(56) References Cited

U.S. PATENT DOCUMENTS 860,517 A * 7/1907 Berglund ..... A63B 3/00 482/41
1,495,536 A * 5/1924 Smith ..... A63B 1/00 D21/797
1,822,786 A * 9/1931 Raffo ..... A63B 9/00 182/214
2,178,271 A * 10/1939 Soss ..... E05D 3/186 16/358
2,608,713 A * 9/1952 Soss ..... E05D 3/186 16/337
3,001,224 A * 9/1961 Soss ..... E05D 3/16 16/379
3,735,979 A * 5/1973 Levenberg ..... A63B 9/00 5/8
3,814,416 A * 6/1974 Munger ..... A63B 9/00 182/20
4,207,886 A * 6/1980 Sorenson ..... E06C 7/42 182/172
4,241,914 A * 12/1980 Bushnell ..... A63B 21/00181 482/130
4,527,797 A * 7/1985 Slade, Jr. ..... A63B 21/0626 482/104
4,657,242 A * 4/1987 Guridi ..... F16B 7/22 482/40
4,759,539 A * 7/1988 Nieppola ..... A63B 21/169 182/95
4,781,374 A * 11/1988 Lederman ..... A63B 21/154 482/99
4,822,029 A * 4/1989 Sarno ..... A63B 22/0023 482/52
4,842,266 A * 6/1989 Sweeney, Sr. ..... A63B 24/00 482/901
4,848,737 A * 7/1989 Ehrenfield ..... A63B 23/03575 482/52
4,923,191 A * 5/1990 Persico ..... A63B 22/001 482/52
5,112,043 A * 5/1992 Gilfillian, Jr. ..... A63B 22/0023 482/37
5,156,580 A * 10/1992 Holland ..... A63B 1/00 482/38
5,336,146 A * 8/1994 Piaget ..... A63B 22/0292 482/52
5,419,747 A * 5/1995 Piaget ..... A63B 22/001 482/70
5,538,487 A * 7/1996 Fulmer ..... A63B 3/00 482/41
5,971,891 A * 10/1999 Humphrey ..... A63B 23/03575 482/54
6,068,579 A * 5/2000 Killian ..... A63B 22/0023 482/54
6,527,678 B1 * 3/2003 Wang ..... A63B 22/0235 482/54
7,004,887 B2 * 2/2006 Pan ..... A63B 22/02 482/54
7,141,006 B1 * 11/2006 Chen ..... A63B 22/02 482/7
7,789,807 B1 * 9/2010 Wang ..... A63B 22/0235 482/52
8,650,713 B2 * 2/2014 Migliorini ..... E05D 3/186 16/370
8,926,479 B2 * 1/2015 Chen ..... A63B 22/02 292/137
9,308,409 B2 * 4/2016 Beaver ..... B65D 25/30
9,474,928 B1 * 10/2016 Maresh ..... A63B 22/02
9,480,874 B2 * 11/2016 Cutler ..... A63B 22/0046
9,580,963 B1 * 2/2017 Wilkes ..... E06C 7/488
10,589,147 B1 * 3/2020 Kostadis ..... A63B 22/025
2002/0103057 A1 * 8/2002 Watterson ..... A63B 22/0023 482/54
2003/0060331 A1 * 3/2003 Polk, III ..... A63B 22/0023 482/20
2004/0058788 A1 * 3/2004 Thompson ..... A63B 21/068 482/96
2004/0214693 A1 * 10/2004 Piaget ..... A63B 21/154 482/52
2004/0242379 A1 * 12/2004 Juva ..... A63B 22/02 482/54
2005/0126855 A1 * 6/2005 Tilley ..... E06C 7/48 182/107
2006/0009332 A1 * 1/2006 Jones ..... A63B 24/0062 482/54
2006/0054391 A1 * 3/2006 Tilley ..... E04D 15/00 182/107
2006/0229171 A1 10/2006 Severino
2007/0037667 A1 * 2/2007 Gordon ..... A63B 22/0017 482/52
2008/0188358 A1 * 8/2008 Kuo ..... A63B 22/0235 482/54
2008/0234111 A1 * 9/2008 Packham ..... A63B 22/02 482/54
2009/0072111 A1 * 3/2009 Piane, Jr. ..... A63B 23/00 248/309.1
2009/0107768 A1 * 4/2009 McCoolidge ..... E06C 1/32 182/207
2009/0163326 A1 * 6/2009 Wang ..... A63B 22/02 482/54
2009/0176627 A1 * 7/2009 Wang ..... A63B 22/0235 482/54
2009/0181830 A1 * 7/2009 Wu ..... A63B 22/001 482/54
2009/0239716 A1 * 9/2009 Wang ..... A63B 22/0235 482/54
2009/0137368 A1 12/2009 Parilla
2010/0048360 A1 * 2/2010 Wang ..... A63B 22/0235 482/54
2011/0021323 A1 * 1/2011 Wu ..... A63B 22/0235 482/54
2012/0165161 A1 * 6/2012 Chen ..... A63B 22/02 482/54
2012/0283070 A1 * 11/2012 Lai ..... A63B 22/02 482/54
2013/0001014 A1 * 1/2013 Halloran ..... E06C 7/46 29/525.01
2013/0035217 A1 * 2/2013 Beck ..... A63B 23/04 482/79
2013/0092096 A1 * 4/2013 Rosenberg ..... A01K 15/027 119/703
2013/0225372 A1 * 8/2013 Rochford ..... A63B 21/0442 482/129
2013/0231216 A1 * 9/2013 Hao ..... A47B 9/20 482/142
2015/0051051 A1 * 2/2015 Liu ..... A63B 22/02 482/54

(56) References Cited

U.S. PATENT DOCUMENTS

| | | | | |
|---|---|---|---|---|
| 2015/0209618 | A1* | 7/2015 | Li | A63B 22/0015 482/7 |
| 2015/0251048 | A1* | 9/2015 | Dalebout | A63B 71/0686 482/54 |
| 2015/0290488 | A1* | 10/2015 | Hopperstad | A63B 17/04 482/38 |
| 2016/0001119 | A1* | 1/2016 | Jue | A63B 21/00069 482/54 |
| 2016/0215563 | A1* | 7/2016 | Ellis | E06C 1/04 |
| 2016/0263417 | A1* | 9/2016 | Golesh | A63B 21/0051 |
| 2017/0095688 | A1* | 4/2017 | Stilson | F16B 2/185 |
| 2017/0136288 | A1* | 5/2017 | Huang | A63B 22/02 |
| 2017/0209733 | A1* | 7/2017 | Beaver | B60S 9/02 |
| 2018/0117382 | A1* | 5/2018 | Johanson | A63B 17/04 |
| 2018/0369631 | A1* | 12/2018 | Risacher | A63B 17/04 |
| 2019/0145170 | A1* | 5/2019 | Clark | E06C 7/06 182/104 |
| 2019/0201739 | A1* | 7/2019 | Johnson | A63B 22/0605 |
| 2019/0247708 | A1* | 8/2019 | Jin | A63B 22/0285 |
| 2019/0247709 | A1* | 8/2019 | Jin | A63B 22/0285 |
| 2019/0321674 | A1 | 10/2019 | Holland | |
| 2020/0171346 | A1* | 6/2020 | Chen | A63B 22/205 |
| 2021/0140237 | A1* | 5/2021 | Hagen | E06C 7/50 |

* cited by examiner

GYMNASTICS SWING SHAPE TRAINER

FIELD OF THE INVENTION

This invention relates to a device for training gymnasts on proper body position, specifically the hollow body position required when performing acrobatic skills on the uneven parallel bars.

BACKGROUND OF THE INVENTION

A primary concern of gymnasts is being in the proper body position for performing various gymnastics skills. In addition to successful completion of any gymnastics skill, proper body position throughout the skill is a requirement. Scoring deductions are taken anytime a gymnast is not in the proper body position while performing a skill.

A hollow body position is required to receive full point credit for many skills on the uneven parallel bars. The hollow body position is characterized by a shortening of the anterior (frontal) portion of the torso and posterior pelvic tilt. Contraction or shortening of the abs, and hips rocked under. A full hollow body position requires the arms extended straight overhead squeezing the ears and legs extended straight out with toes pointed.

A major component in determining skill acquisition is psychomotor ability. Psychomotor refers to skills that involve physical movement as well as a mental component. In order to develop psychomotor skills, athletes need to consider perceptual skills, proprioception, and motor skills. Balance is sometimes called proprioception to reflect the greater sense awareness of position as well as balance. It relies on information from the eyes, inner ear, and somatic receptors (in the joint capsule, tendons, ligaments, and muscles). Information from these sense receptors pass to the brain stem and cerebellum regions of the brain, which then organize that information into spatial awareness. This information is used to enable athletes to coordinate movement into a smooth sequence of events.

Motor skills include all those voluntary movements of muscles in the correct sequence. However, this does not just involve the muscles directly responsible for the desired movement, but also the appropriate postural muscles to enable athletes to remain in the proper position and coordinated, hence the necessity for the information regarding proprioception.

There are three phases with learning a psychomotor skill, namely:

(1) Early or Cognitive Phase—This is where the steps of the task are learned, for instance the controls of a car. Speed is important as at first there is too much information. If the task is slowed down there is less information to handle at any one time, which will facilitate learning.

(2) Linking or Action Phase—This is where the responses are tied to an appropriate stimulus. For instance, when learning a poem one line tends to trigger the next. It is much harder to quote the last line and if asked, it is often necessary to mentally run through the entire poem to find the required part. Therefore, each line is the trigger for remembering the next.

(3) Automatic Response—This is where the skill becomes more and more automatically performed as control is taken over by the lower centers of the brain. At this stage the performance is smooth and automatic. Therefore, psychomotor skills are retained as complete programs or neurological pathways. The rhythm or sequence developed at the linking phase will now be embedded so the athlete increasingly depends on internal rather that external cues to time their responses.

Repeating a movement until it becomes embedded as a neurological pathway that can be called upon when required has obvious benefits to the athlete. This is used many times, for instance, when tennis players repeatedly practice their back hand. A tennis player may have a perfect back hand but will not be able to use that skill unless he or she can get into the appropriate position. The same is true for gymnasts, repeatedly practicing the proper body position allows the position to become automatic while performing new and more difficult skills. The gymnastics swing shape training device provided by the invention facilitates an improved method of making the hollow body position an automatic response.

SUMMARY OF THE INVENTION

Typically, gymnasts train their bodies in strength, skills, and body position. In order to learn and maintain the proper body position, gymnasts use various stretches, training exercises, spotting by coaches, and positioning devices. Allowing the gymnast to hold the proper body position trains the gymnast's body for the feel of the position and allows for "muscle memory" to help obtain the proper position more easily in subsequent attempts. Eventually, the proper position becomes an automatic response as described above and the gymnast can focus on other components of performing the skill successfully. Currently, no device exists for specifically training the proper hollow body position that is a requirement for many skills performed on the uneven parallel bars.

The present invention provides a device that supports a gymnast in an outstretched position while allowing for maintaining a proper hollow body position. A gymnast can grasp an adjustable rung as if holding one of the uneven parallel bars and rest her feet on a fixed rung such that the gymnast can maintain a hollow body position while outstretched. The adjustable nature of the device allows for accommodating gymnasts of any size. The ease of use allows for quickly customizing the device for each gymnast without a lengthy delay between users.

The present device comprises a rectangular frame with an adjustable rung. In an embodiment, the frame is of unitary construction. In another embodiment, the frame consists of two side support members and two stationary rungs. Another embodiment provides for the side support members and the top cross portion of the frame to be of unitary construction with one stationary rung in a fixed position. Various embodiments are possible for the engagement of the adjustable rung with the frame. Additionally, the device can be used flat on the ground, at an angle with one end supported at a height, or substantially upright against a wall or other support. Optional feet may be used to provide additional stability in any position, especially if the feet have a non-slip bottom surface. Further, other optional elements may include an object placed below the gymnast's mid-section, such as a large ball, to encourage the gymnast to maintain a rounded mid-section and hollow body position.

Any suitable materials may be used for the side support members such as wood, metal, PVC, high density foam, composites, or laminate provided that the side support members and stationary rungs form a substantially rigid frame and can support the weight of the gymnast and pressure applied by the gymnast when using the device. Likewise, the rungs may also be of any suitable material to form a substantially rigid frame and support the weight of the gymnast and pressure applied by the gymnast when the device is in use. Preferably, the device is lightweight so that it can be easily repositioned and/or is not a tipping or falling hazard when used in an angled or upright position.

DETAILED DESCRIPTION OF THE INVENTION

Figure 1:
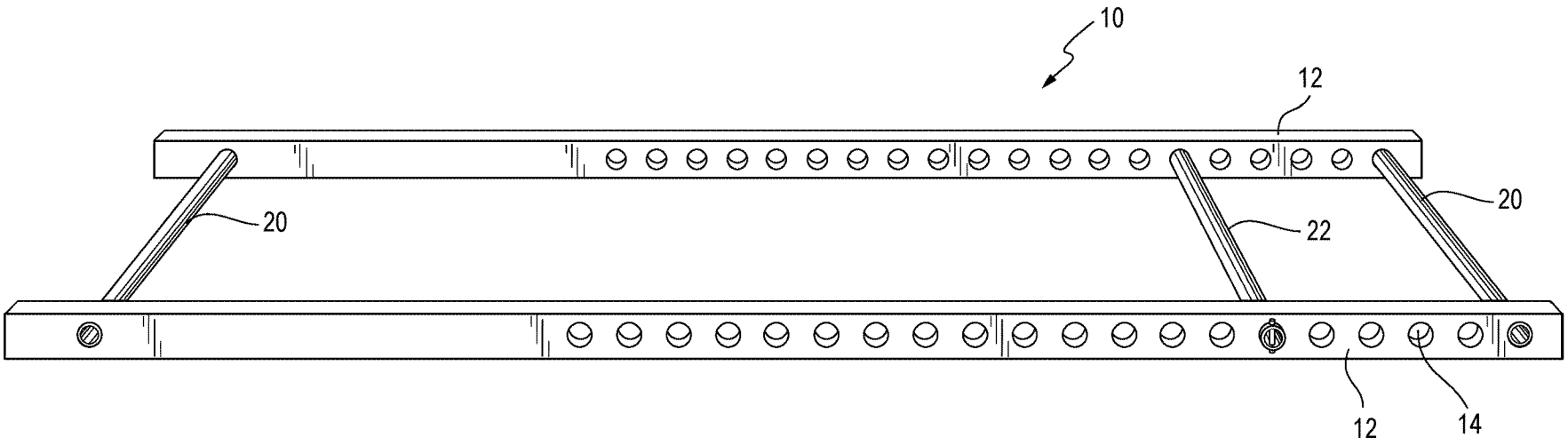
FIG. 1 shows a perspective view of an embodiment of the swing shape trainer.

As shown in FIG. 1, gymnastics swing shape trainer 10 includes a pair of substantially parallel side support members 12. Side support members 12 are held in place by stationary rungs 20. Stationary rungs 20 are affixed near both end portions of side support members 12 and provide structural support to swing shape trainer 10 while keeping side support members 12 substantially parallel to each other. When assembled, side support members 12 and stationary rungs 20 form a rectangular frame. In the embodiment shown, side support members 12 have a plurality of apertures 14 sized to receive adjustable rung 22. Apertures 14 on one side support member 12 align with apertures 14 on the opposite side support member 12 forming sets of apertures. Adjustable rung 22 is positioned in any one set of apertures 14 to accommodate the size of the gymnast using the device. When in use, the gymnast grasps adjustable rung 22 with her hands while standing on her toes on lower stationary rung 20. Adjustable rung 22 should be positioned such that the gymnast is in an outstretched position with her arms over her head; the gymnast's back should be slightly rounded in a "hollow body" position required for uneven parallel bar skills. Preferably, adjustable rung 22 has a circular cross section for ease of grasping by hand.

Figure 2:
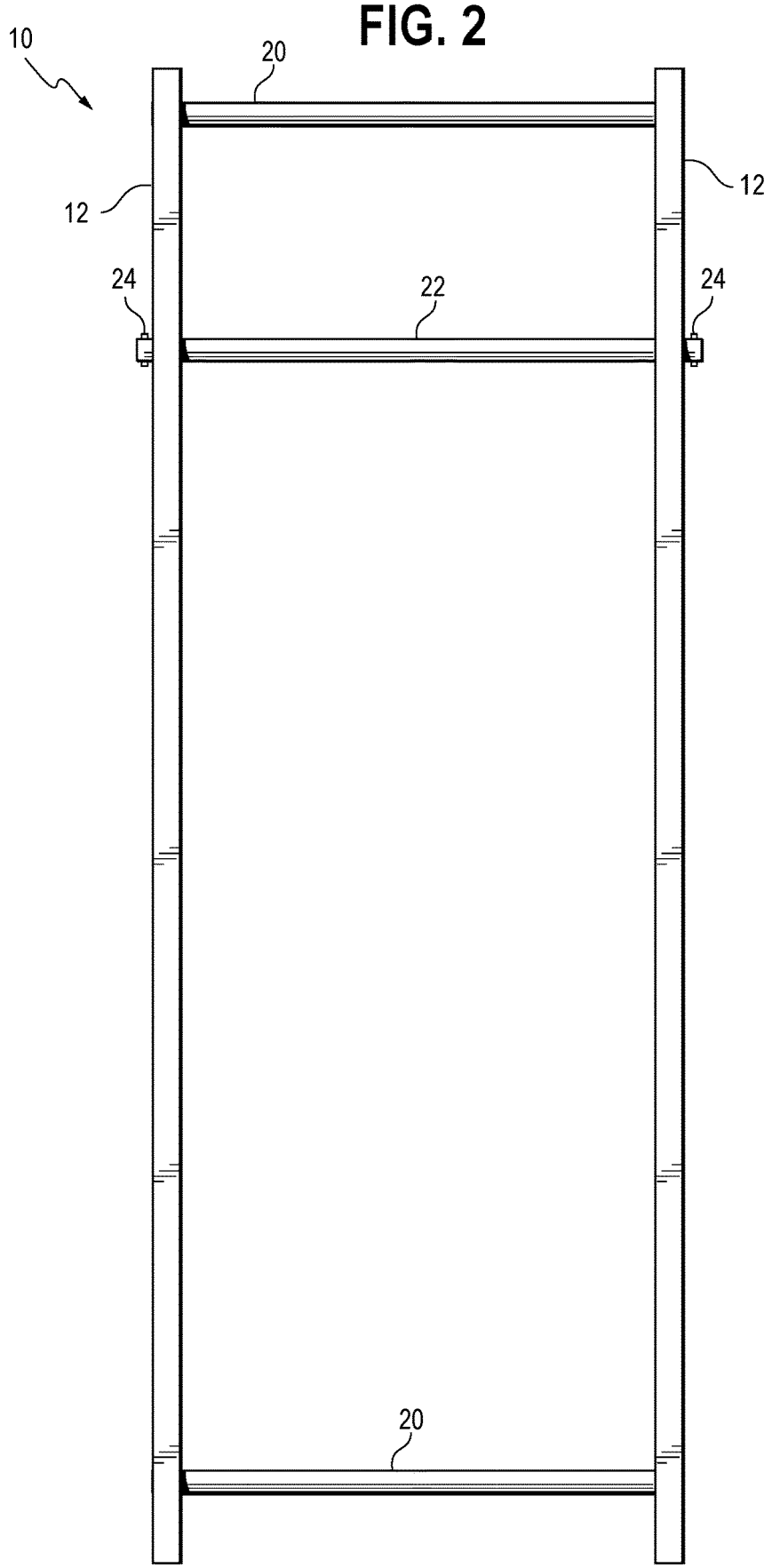
FIG. 2 shows a front view of an embodiment of the swing shape trainer with pins for securing the adjustable rung.

As shown in FIG. 2, in an embodiment, adjustable rung 22 can extend past the outer surfaces of side support members 12. Fastener 24 secures adjustable rung 22 so that adjustable rung 22 cannot pass through apertures 14 without removal of fastener 24. This prevents accidental removal of adjustable rung 22 from apertures 14 during use.

Figure 3:
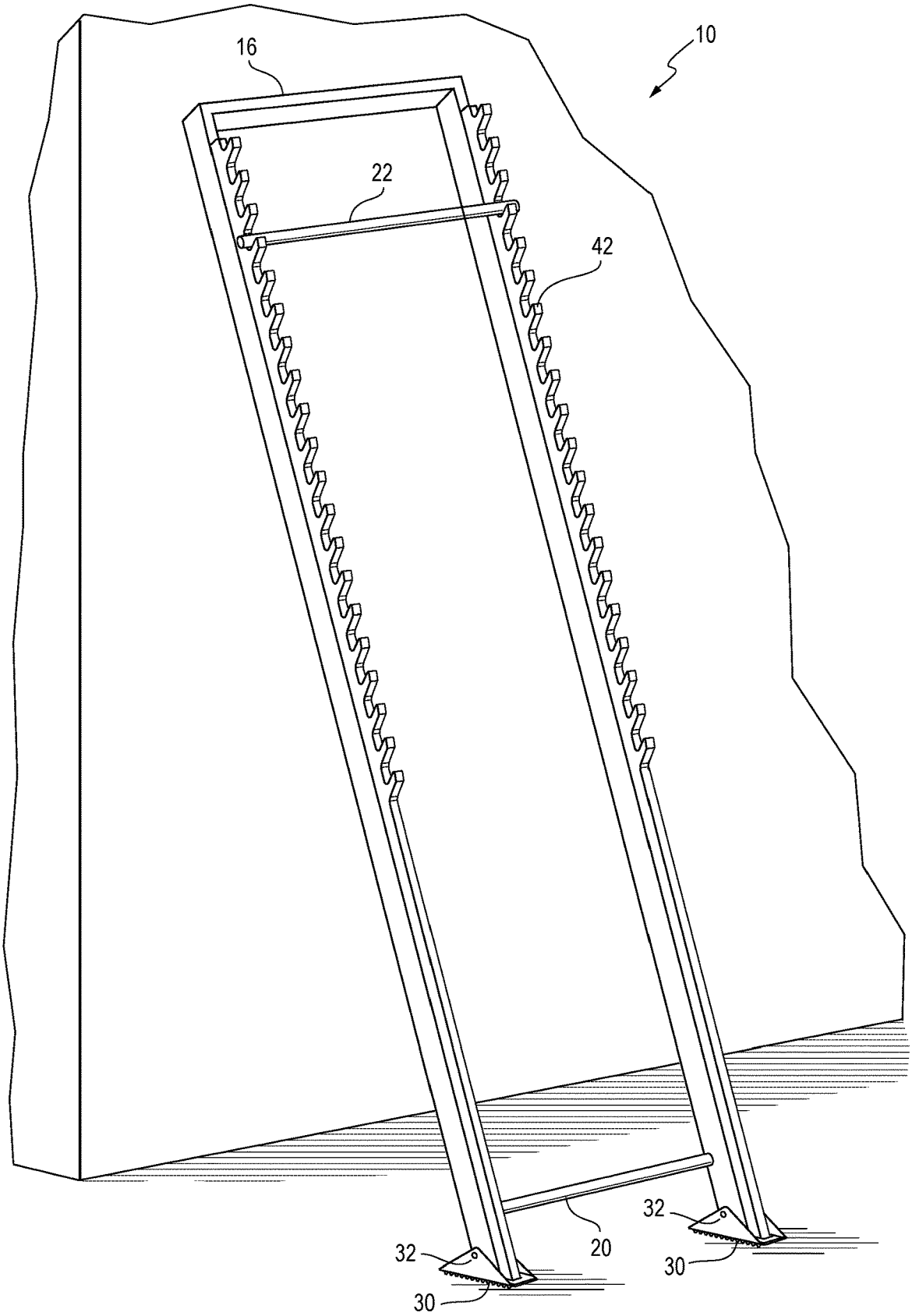
FIG. 3 shows a perspective view of another embodiment of the swing shape trainer with optional feet and notched adjustable rung positioning.

FIG. 3 shows a different embodiment of gymnastics swing shape trainer 10. In FIG. 3, the side support members and the upper cross portion are of unitary construction forming frame 16. Stationary rung 20 is affixed near the bottom end portions of frame 16 as shown or may also be of unitary construction with frame 16. The embodiment shown has notches 42 for positioning adjustable rung 22. Notches 42 on one side of the front surface of frame 16 align with notches 42 on the opposite side of the front surface of frame 16 such that notches 42 form sets of notches. Notches 42 allow for quick and easy removal of adjustable rung 22 from one position and placement into another. Notches 42 can be angled in a variety of directions or can have a shape such that adjustable rung 22 is held securely in place when pressure is applied by the user to prevent accidental removal while in use. Swing shape trainer 10 can be used positioned flat on the ground or in an angled or upstanding position against a wall or other support as shown. The embodiment shown in FIG. 3 also shows optional feet 30. Feet 30 are secured to swing shape trainer 10 by fastener 32. Feet 30 pivot about fastener 32 such that feet 30 are in contact with the ground when swing shape trainer 10 is used in an upright or angled position but can be pivoted away from the ground when swing shape trainer 10 is used in a flat position.

Figure 4:
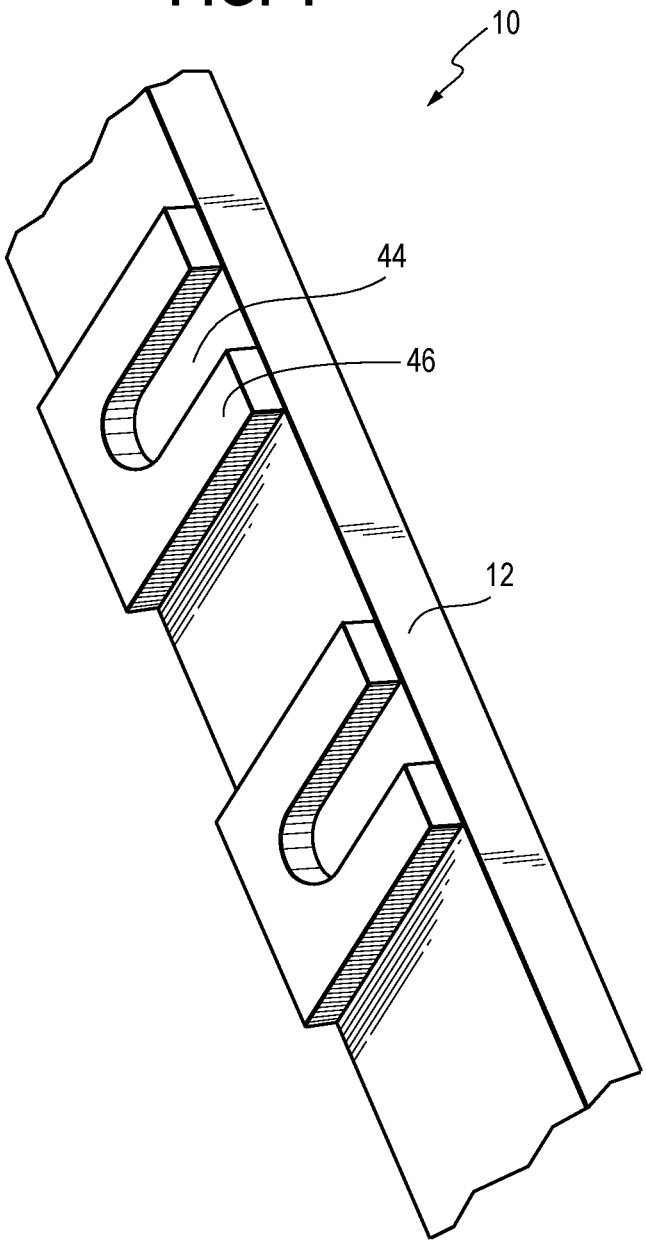
FIG. 4 shows a close-up view of a different embodiment of the swing shape trainer with slots for engaging the adjustable rung.

FIG. 4 shows a zoom of another embodiment with blocks 46 for positioning of adjustable rung 22. Blocks 46 are positioned on the inner surfaces of side support members 12. Blocks 46 form slots 44 which receive the end portions of adjustable rung 22. Blocks 46 on one side support member 12 align with blocks 46 on the opposite side support member 12 such that the slots 44 align and form sets of slots. Slots 44 are sized to receive adjustable rung 22. Adjustable rung 22 slides into a set of slots 44 for positioning during use and slides out for repositioning for the next user. Slots 44 can be angled in a variety of directions or can have a shape such that adjustable rung 22 is held securely in place when pressure is applied by the user preventing accidental dislodgement while in use.

In preparation for use, the gymnast or coach determines the proper position for the adjustable rung based on the height of the gymnast. The adjustable rung is positioned in the appropriate position and secured in place as required by the embodiment of the invention being used. The gymnast places her feet on the lower stationary rung and grasps the adjustable rung with her hands. Preferably, the adjustable rung is positioned such that the gymnast stands on her toes with her arms outstretched over her head yet is able to maintain a hollow body position (slight curve to her torso). The position is held as determined necessary by the gymnast or coach to properly train the body to "remember" the hollow body position.

An embodiment of the gymnastics swing shape trainer comprises a pair of substantially parallel side support members each having an inner surface, an outer surface, a front surface, a rear surface, a top end portion, and a bottom end portion; a pair of substantially parallel stationary rungs, each rung having a first end portion and a second end portion, each end portion affixed to a side support member, one stationary rung positioned near the top end portions of the side support members and one stationary rung positioned near the bottom end portions of the side support members, the side support members and the stationary rungs being in a substantially perpendicular relationship to each other such that the stationary rungs and side support members form a rectangular frame; an adjustable rung having a first end portion and a second end portion and a length at least substantially equal to the length of the stationary rungs; and a plurality of apertures through the side support members from the outer surfaces of the side support members through the inner surfaces of the side support members, each aperture through one side support member aligning with an aperture on the other side support member, each aligned set constituting a pair of apertures, each pair of apertures being sized to receive the adjustable rung.

In another embodiment, the end portions of the adjustable rung extend past the outer surfaces of the side support members and a fastener inserted through the end portions of the adjustable rung prevents the adjustable rung from passing through the aperture. The fastener can be any known fastener such as a pin, a bolt, a screw, a quick-release pin, or the like.

Other embodiments are possible having various features for holding the adjustable rung in a stable position while in use yet being easily repositionable for the next user such as having a plurality of notches on the front surface of the side support members, each notch on one side support member aligning with a notch on the other side support member, each aligned set constituting a pair of notches, each pair of notches sized to receive the adjustable rung or a plurality of blocks on the inner surfaces of the side support members, each block having a slot, each slot on one side support member aligning with a slot on the other side support member, each aligned set constituting a pair of slots, each pair of slots sized to receive the adjustable rung.

Other methods of engagement of the adjustable rung are contemplated such as a threaded engagement with the side support members or attachment via a ratcheting device. Additionally, the adjustable rung can be attached via straps or ropes to hold the rung in the desired position. The adjustable rung can also be moved along the inner surface of the side support members via a rail either on the inner surface of the side support members or within the side support members.

In another embodiment, the rectangular frame can be of unitary construction or the side support members and the top cross portion of the frame are of unitary construction and a lower stationary rung is located near the bottom end portions of the side support members.

Any of the aforementioned embodiments of the gymnastics swing shape trainer may also include at least two feet pivotably attached to bottom end portions of the side support members, or alternately, two feet pivotably attached to the bottom end portions of the side support members and two feet pivotably attached to the top end portions of the side support members.

Additionally, optional accessories may be used to aid the gymnast in maintaining the proper body position. For example, a large ball or other object can be placed below the gymnast's mid-section. This will give the gymnast both a visual and physical guide to help hold the hollow body position.

The foregoing discussion and the examples are illustrative of the present invention, and should not be construed as limiting. The device can be modified various ways for temporarily securing the adjustable rung while in use yet rendering it readily adjustable for the next user. Likewise, other means of stabilizing the device besides pivotable feet are possible. Still other variations within the spirit and scope of the claims are possible, and will readily present themselves to those skilled in the art.

I claim:

1. A gymnastics swing shape trainer comprising:

a pair of parallel side support members each of the pair of parallel side support members having an inner surface, an outer surface, a front surface, a rear surface, a top end portion, and a bottom end portion;

a pair of parallel stationary rungs, each of the pair of parallel stationary rungs having a first end portion and a second end portion, each of the first and second end portion affixed to a side support member of the pair of parallel side support members, one stationary rung of the pair of parallel stationary rungs positioned near the top end portions of the pair of parallel side support members and one stationary rung of the pair of parallel stationary rungs configured to support a gymnast's feet positioned near the bottom end portions of the pair of parallel side support members, the pair of parallel side support members and the pair of parallel stationary rungs being in a substantially perpendicular relationship to each other such that the pair of parallel stationary rungs and the pair of parallel side support members form a rectangular frame, the rectangular frame formed by the pair of parallel side support members and the pair of parallel stationary rungs is of unitary construction;

an adjustable rung configured to be grasped by the gymnast's hands having a first end portion and a second end portion and a length at least equal to a length of the pair of parallel stationary rungs;

a plurality of apertures through the pair of parallel side support members from the outer surfaces of the pair of parallel side support members through the inner surfaces of the pair of parallel side support members, the plurality of apertures are located between the pair of parallel stationary rungs, each aperture of the plurality of apertures through one of the pair of parallel side support member aligning with corresponding aperture on other one of the pair of parallel side support member, each aligned aperture of the plurality of apertures constituting a pair of apertures, each pair of apertures being sized to receive the adjustable rung; and, wherein the gymnastics swing shape trainer is configured such that the adjustable rung is at a distance from the one stationary rung of the pair of parallel stationary rungs positioned near the bottom end portions of the pair of parallel side support members that puts the gymnast in a hollow body position.

2. The gymnastics swing shape trainer of claim 1 wherein the length of the adjustable rung is such that when positioned with two aligned apertures of the plurality of apertures, the first and second end portions of the adjustable rung extend past the outer surfaces of the pair of parallel side support members and a fastener inserted through either the first end portion or the second end portion of the adjustable rung prevents the adjustable rung from passing through the two aligned apertures of the plurality of apertures.

3. The gymnastics swing shape trainer of claim 2 wherein the fastener comprises a pin, a bolt, a screw, or a quick-release pin.

4. The gymnastics swing shape trainer of claim 1 wherein one foot is pivotably attached to the bottom end portion of each of the pair of parallel side support members.

5. A method of training using a gymnastics swing shape trainer, the method comprising:

placing, preferably in a horizontal position, the gymnastic swing shape trainer on a flat surface, the gymnastic swing shape trainer comprising:

a pair of parallel side support members each of the pair of parallel side support members having an inner surface, an outer surface, a front surface, a rear surface, a top end portion, and a bottom end portion;

a pair of parallel stationary rungs, each of the pair of parallel stationary rungs having a first end portion and a second end portion, each of the first and second end portion affixed to a side support member of the pair of parallel side support members, one stationary rung of the pair of parallel stationary rungs positioned near the top end portions of the pair of parallel side support members and one stationary rung of the pair of parallel stationary rungs configured to support a gymnast's feet positioned near the bottom end portions of the pair of parallel side support members, the pair of parallel side support members and the pair of parallel stationary rungs being in a perpendicular relationship to each other such that the pair of parallel stationary rungs and the pair of parallel side support members form a rectangular frame, the rectangular frame formed by the pair of parallel side support members and the pair of parallel stationary rungs is of unitary construction;

an adjustable rung configured to be grasped by the gymnast's hands having a first end portion and a second end portion and a length at least equal to a length of the pair of parallel stationary rungs;

a plurality of apertures through the pair of parallel side support members from the outer surfaces of the pair of parallel side support members through the inner surfaces of the pair of parallel side support members, the plurality of apertures are located between the pair of parallel stationary rungs, each aperture of the plurality of apertures through one of the pair of parallel side support member aligning with corresponding aperture on other one of the pair of parallel side support member, each aligned aperture of the plurality of apertures constituting a pair of apertures, each pair of apertures being sized to receive the adjustable rung;

wherein the gymnastics swing shape trainer is configured such that the adjustable rung is at a distance from the one stationary rung of the pair of parallel stationary rungs positioned near the bottom end portions of the pair of parallel side support members that puts the gymnast in a hollow body position;

inserting the adjustable rung through the aperture of the plurality of apertures through one of the pair of parallel side support member and through the corresponding aperture on the other one of the pair of parallel side support member; and, securing the adjustable rung with a fastener inserted through either the first end portion or the second end portion of the adjustable rung.

* * * * *